United States Patent [19]

Piccini

[11] 4,185,821

[45] Jan. 29, 1980

[54] HYDRO PNEUMATIC BATTING PRACTICE DEVICE AND METHOD

[76] Inventor: Silvio D. Piccini, 13620 SW. 74 Ct., Miami, Fla. 33158

[21] Appl. No.: 899,453

[22] Filed: Apr. 24, 1978

Related U.S. Application Data

[63] Continuation-in-part of Ser. No. 667,164, Mar. 15, 1976, Pat. No. 4,093,217.

[51] Int. Cl.[2] ..... A63B 69/40

[52] U.S. Cl. ..... 273/26 R

[58] Field of Search ..... 273/26 A, 26 R, 55 A, 273/25; 272/76, 77, 78; 9/8 R; 46/87

[56] References Cited

U.S. PATENT DOCUMENTS

| | | | |
|---|---|---|---|
| 291,015 | 12/1883 | Rumsey | 272/77 |
| 318,766 | 5/1885 | Longden | 272/77 |
| 565,747 | 8/1896 | Hawthorne et al. | 272/77 |
| 1,708,638 | 4/1929 | Smith | 273/55 A |
| 1,817,364 | 8/1931 | Goldsmith | 273/55 A |
| 2,381,394 | 8/1945 | Beach, Jr. | 9/8 R |
| 2,561,016 | 7/1951 | Ford et al. | 46/87 |
| 2,937,872 | 5/1960 | Gilman | 273/55 A |
| 3,266,068 | 8/1966 | High | 9/8 R |
| 3,386,733 | 6/1968 | Russo et al. | 273/26 R |
| 3,703,285 | 11/1972 | Perry | 273/25 |

*Primary Examiner*—Richard C. Pinkham
*Assistant Examiner*—T. Brown
*Attorney, Agent, or Firm*—Jack E. Dominik

[57] ABSTRACT

A batting practice device is disclosed which is a tubular elastomeric cylinder closed at both ends and having a mounting tube down the center with a bore capable of receiving a rope or other tension suspension member. A valve is provided for filling the interior portion of the closed end cylinder to a depth of 30% to 70% of the volume with a fluid such as water. The method contemplates providing a batter with such a structure, and repetitively swinging a bat against the subject device to simulate the resistance rebound effect of striking a ball.

4 Claims, 4 Drawing Figures

HYDRO PNEUMATIC BATTING PRACTICE DEVICE AND METHOD

RELATED APPLICATIONS

This application is a continuation-in-part of my previously filed patent application Ser. No. 667,164 filed Mar. 15, 1976, (Pat. No. 4,093,217), entitled "Batting Practice Device".

FIELD OF THE INVENTION

The present invention is directed to sporting goods, and more specifically to the subject matter of baseball equipment and practicing swinging a bat. The batter is much like a prize fighter or football player when he addresses the subject device as they would a punching bag or tackling dummy. Relevant patent literature may be found in Classes 9, Subclass 8; Class 46, Subclass 87; Class 114, Subclass 219; Class 272, Subclasses 76, 77, 78; Class 273, Subclasses 55, 26 and 26(a).

SUMMARY OF THE PRIOR ART

Relevant patents appearing in the prior art include U.S. Pat. Nos. 291,015; 1,817,364; 3,558,135; 1,605,102; 2,826,416; 3,659,847; 1,708,638; 2,960,055, British Patent No. 518,988, and those patents cited as references in connection with my previously filed patent applications Ser. No. 667,164 and 800,419. With the exception of my previously two filed patent applications, the main subject of the prior art is directed to football dummies or punching bags. While they are closed at both ends, in the main, they do not have sufficient weight or inertia to simulate the striking of a ball with a bat. Furthermore they are not readily suspended in a variety of heights to accomodate various size batters. Insofar as batting practice devices heretofore known are concerned, a suspended automobile tire is perhaps the best known. It suffers from the deficiency of not being repositionable readily for further swings, and not providing a uniform vertical surface simulating that of the normal strike zone experienced by a hitter.

SUMMARY

The present invention is directed to a batting practice device in which the body portion is essentially an elastomeric cylindrical structure being closed at both ends and having a central tube providing a passage way in uninterrupted fashion for a rope or similar tension member to suspend the same. Ideally the device is further provided with filling means so that the same can be filled in a range between 30% and 70% full of water. Optionally black bands are provided at the upper and lower portion to define a strike zone. The method contemplates the use of the subject apparatus, by a batter striking a bat repetitively against the fluid filled batting practice device which is further provided by the method.

In view of the foregoing it is a principal object of the present invention to provide a hydro pneumatic batting practice device which is relatively inexpensive, and can be used by little leaguers through high school.

A further object of the present invention is to provide a simple support for a batting practice device which can be erected in minutes even by little leaguers to a limb of a tree or the like.

Still another object of the present invention is to provide a batting practice device which utilizes the weight and mobility of a fluid such as water and which can be emptied for storage such as during the winter when the fluid might freeze and the little leaguers otherwise are not busy playing baseball.

Still a further but directly related object of the present invention is to provide a batting practice device which can be shipped as a kit, and assembled without the use of any special tools.

Another object of the present invention is to provide the bulk of the advantages of my previously filed patent applications in a device which is more directed to the use of little leaguers through high school which can be furnished at a lower cost and yet be meaningful for their practice.

DESCRIPTION OF ILLUSTRATIVE DRAWINGS

Further object and advantages of the present invention will become apparent as the following description proceeds, taken in conjunction with the accompanying illustrative drawings in which.

DESCRIPTION OF THE PREFERRED EMBODIMENT

Figure 1:
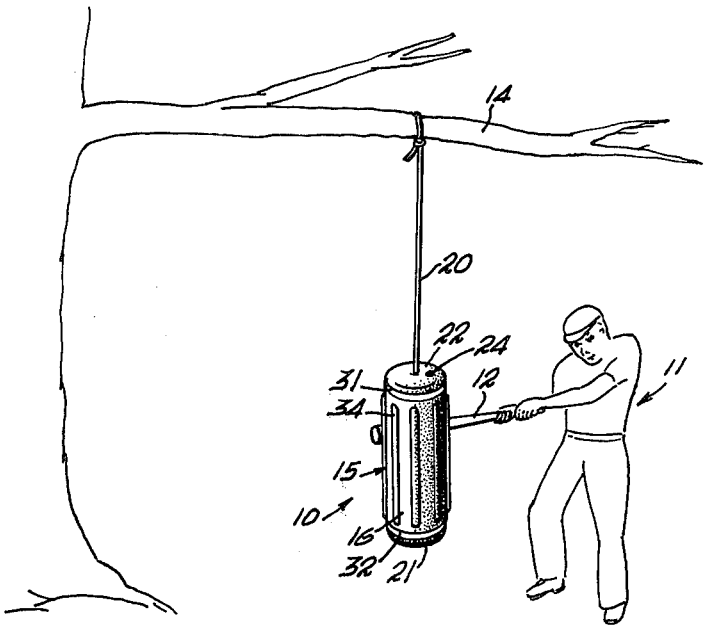
FIG. 1 is a diagramatic view of a batter utilizing the subject batting practice device as swung from the limb of a tree.

As noted in the accompanying drawings, particularly in FIG. 1, the subject batting device 10 is used by a batter 11 who swings his bat 12 against it. The same is conveniently swung from a tree limb 14, by means of the rope sling 20. As noted in FIG. 2, the batting device 10 is primarily a closed cylinder 15 which, as noted in FIG. 3, has an outer face 16, and an inner face 18. The closed cylinder is formed of an elastomeric material such as neoprlan, synthetic rubber derivatives, and the like.

Figure 3:
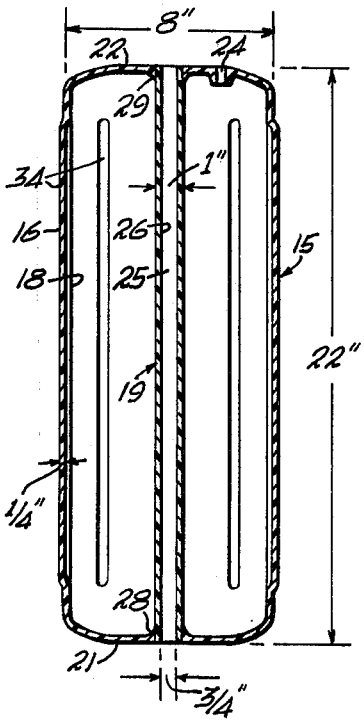
FIG. 3 is a transverse sectional view taken through section line 3—3 of FIG. 2 in essentially the same scale as FIG. 2.
Figure 4:
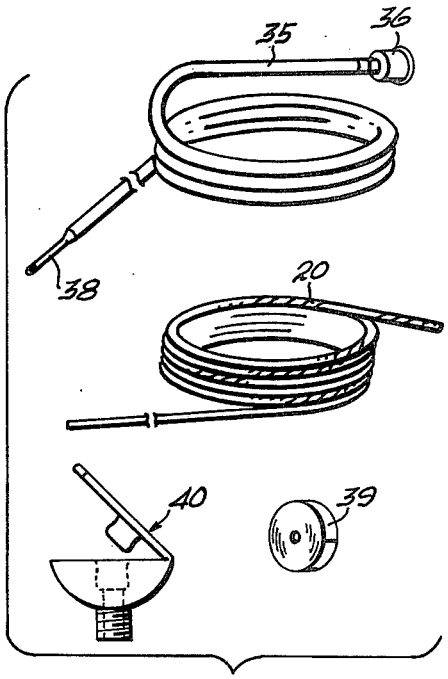
FIG. 4 is a view of the component parts which may be shipped with the kit including a filler hose, rope, and black tape roll, and valve.

Centrally of the closed cylinder 15, as noted in FIG. 3, is a mounting tube 19 which extends coaxially through the closed end cylinder 15 from the lower end 21 to the upper end 22.

Figure 2:
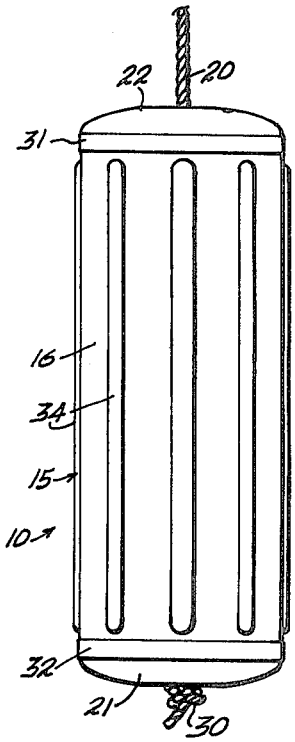
FIG. 2 is a front elevation in an enlarged scale from FIG. 1 of the batting practice device showing the supporting rope knoted at its lower portion.

Provision is made in the upper end 22 of the closed cylinder 15 for a valve connection 24 which is employed to fill the cylinder, as well as to drain the same. The rope bore 25 defined by the tube inner wall 26 is of a diameter to accomodate the rope sling 20 which, as noted in FIG. 2, is secured at its lower end by means of a knot 30. The tube is provided with a bottom seal 28 and a top seal 29 in fluid tight relationship with the lower end 21 and upper end 22 of the closed cylinder 15. As noted in FIG. 2, a strike zone is defined by an upper strike zone band 31 and a lower strike zone bank 32. Preferably the strike zone bands 31, 32 are black tape applied by the user to define his own strike zone appropriate for his use. Additionally it will be noted for strengthening purposes that longitudinal ribs 34 are provided on the periphery of the closed cylinder 15.

When the unit is shipped as a kit, the auxilliary equipment includes a hose 35 which terminates at one end with a female faucet connector 36, and at the other end with a filler insert 38 proportioned to accomodate the valve 40 when it is secured in the valve connection 24 provided on the upper end 22 of the closed cylinder 15. Finally, a roll of preferably black tape 39 is provided in the kit so that the strike zone, as set forth above, can be determined by the purchaser.

The method of the present invention contemplates providing a closed end fluid retentive cylinder, such as that referred to above as the closed cylinder 15, and providing a longitudinal tube in the central portion of said cylinder having an uninterrupted rope bore, such as the mounting tube 19 defined in connection with the description of the subject device.

Important to the method of the invention is to swing the cylinder from a support above the cylinder by utilizing a flexible tension member having means for securing the same at a lower portion of the closed end of the cylinder. A critical step in the method is the filling of the closed end cylinder, such as described closed cylinder 15 above, with a fluid such as water to at least 30% of its volume, and preferably between 50% and 70% of its volume. Thereafter the method concludes by repetitively swinging a bat by a batter against the periphery of the cylinder.

COMMERCIAL EMBODIMENT

In a commercial embodiment of the subject device, the material is elastomeric and has a wall thickness of approximately ¼ inch, is approximately 8 inches in diameter, 22 inches in height, and weighs approximately 6 pounds 9 ounces. The same is similar to a boat fender sold under the trademark "FEND-AIRE", and manufactured by Barberton Plastics Products, Inc., a subsidiary of Spartek, Inc. The boat fender, however, does not have the filler valve, which preferably is an insert with a central bore which resiliently closes, but accomodates a needle for filling.

When the unit is filled to its capacity of 30% with water, it weighs approximately 13.5 pounds. At 50% it weighs approximately 22.5 pounds, and at 70% it weighs approximately 31.5 pounds. Generally the lower percentage charges of fluid are employed with the smaller little leaguers, and as they progress through high school, the amount of fluid placed in the closed end hollow cylinder is increased to the upper range.

The central tubular member ideally is a 1 inch diameter to, having a ¾ inch internal diameter which readily accomodates a ½ inch rope which can be anywhere from 6 to 16 feet in length, being secured at its upper end to a fixed support, and passing through the mounting tube and provided with a knot at the lower end.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A batting practice device comprising, in combination, an elastomeric tubular cylinder closed at both ends, a mounting tube concentric with said cylinder and sealed in fluid tight relationship at its lower end to define a rope bore therein of a non-interrupted nature from end to end of the cylinder, a filling means at the upper end of said cylinder for the injection of fluid and retention of said fluid, a single flexible tension member inserted in the rope bore and extending upwardly to a support, and terminating at a securing element at the lower end, said cylinder containing non-gaseous fluid to a level between 30%-70% of the volume capacity of the closed end cylinder for providing sufficient inertia to present to a bat striking against said cylinder the resistive forces of simulating striking a ball, said tension member proportioned so that the cylinder is horizontally opposed to a major portion of the strike zone of a batter, said support and tension member aligned so that the cylinder is vertically opposed to a major portion of the strike zone of a batter relative to an imaginary home plate, whereby the device substantially occupies airspace defining a strike-zone.

2. In the batting practice device of claim 1, said tubular member being formed of an elastomeric material having a height of at least twice its diameter, said ratio of height and diameter representing the approximate dimensions of a strike zone, whereby the presence of the device accustoms the batter to the dimensions of a strike zone.

3. In the batting practice device of claim 1, said closed end member having longitudinal uniformly spaced ribs around its periphery.

4. A method of practicing batting including, providing a closed end fluid retentive cylinder formed of an elastomeric material, said cylinder characterized by unitary construction to present a non-penetratable barrier to objects striking against it, said cylinder further characterized by having dimensions substantially defining the air space of a strike zone, providing a longitudinal tube in the central portion of said cylinder having an uninterrupted rope bore therein, slinging the cylinder from a support above the cylinder by utilizing a flexible tension member having means for securing the same at the lower portion of the closed end cylinder, adjusting the length of said tension member so that the cylinder is horizontally opposed to a major portion of the strike zone of a batter, aligning the support and tension member so that the cylinder is vertically opposed to a major portion of the strike zone of a batter relative to an imaginary home plate, filling said cylinder to at least 30% of its interior volume with a non-gaseous fluid, and repetitively swinging a bat by a batter against the periphery of the cylinder.

* * * * *